US007696632B1

(12) United States Patent
Fuller

(10) Patent No.: US 7,696,632 B1
(45) Date of Patent: Apr. 13, 2010

(54) HYDRAULIC AIR COMPRESSOR AND GENERATOR SYSTEM

(76) Inventor: Steve Fuller, 15 N. 17th St., Cottonwood, AZ (US) 86326

( * ) Notice: Subject to any disclaimer, the term of this patent is extended or adjusted under 35 U.S.C. 154(b) by 173 days.

(21) Appl. No.: 11/555,758

(22) Filed: Nov. 2, 2006

(51) Int. Cl.
*F02C 3/12* (2006.01)
*F04F 11/00* (2006.01)

(52) U.S. Cl. ..... 290/54; 290/43

(58) Field of Classification Search ..... 290/1 R, 290/43, 54, 44, 55, 52, 42, 53; 60/370
See application file for complete search history.

(56) References Cited

U.S. PATENT DOCUMENTS 892,772 A 7/1908 Taylor
1,007,095 A 10/1911 Girard
2,013,236 A 9/1935 Dell
2,382,421 A 8/1945 Johnson et al.
2,478,051 A * 8/1949 Nordell ..... 417/320
2,861,737 A 11/1958 Bowen
4,307,299 A 12/1981 Norton
4,345,160 A * 8/1982 Smith ..... 290/52
4,408,452 A * 10/1983 Tsunoda ..... 60/398
4,443,707 A * 4/1984 Scieri et al. ..... 290/4 R
4,797,563 A 1/1989 Richardson
5,099,648 A 3/1992 Angle
5,142,870 A 9/1992 Angle
6,051,892 A * 4/2000 Toal, Sr. ..... 290/43
6,272,839 B1 8/2001 Karl
6,861,766 B2 * 3/2005 Rembert ..... 290/43

* cited by examiner

*Primary Examiner*—Nicholas Ponomarenko
(74) *Attorney, Agent, or Firm*—Booth Udall, PLC

(57) ABSTRACT

A hydraulic air compressor and generator system may comprise: a hydraulic air compressor comprising a compressed air pipe for conveying the compressed air from the separator chamber; and an electrical power generator positioned in line with the compressed air pipe so that compressed air will directly power the generator. A method for operating an electrical power generator may comprise: positioning the electrical power generator in line with a compressed air pipe of a hydraulic air compressor; and using compressed air output from the HAC to directly power the electrical power generator.

17 Claims, 7 Drawing Sheets

HYDRAULIC AIR COMPRESSOR AND GENERATOR SYSTEM

BACKGROUND

A. Technical Field

This document relates to a hydraulic air compressor and generator system.

B. Background Art

Conventional hydraulic air compressors are known. They have an entrainment head above the compressor head of the hydraulic air compressor. As such, conventional hydraulic air compressors are only able to be located in limited use environments. Many conventional hydraulic air compressors do not provide a closed cycle system, and those that appear or profess to, if any, do not provide a true closed cycle system in all use environments (e.g., when placed in a lake or ocean for example). Additionally, the compressed air output of conventional hydraulic air compressors are used to directly power gas turbines and other fossil fuel requiring equipment which produce pollution.

SUMMARY

In an aspect, this document features a hydraulic air compressor and generator (HACG) system. The HACG system may comprise: at least one hydraulic air compressor (HAC) comprising a compressed air pipe for conveying compressed air; and an electrical power generator positioned in line with the compressed air pipe so that compressed air will directly power the generator.

HACG implementations may include one, any combination, or all of the following.

The at least one HAC may further comprise one, a combination, or all of the following: a recirculating pump for providing a flow of water for compressing air; an air entrainment pipe for transporting the flow of water and entrained air; a separator chamber in fluid communication with the air entrainment pipe for separating entrained and compressed air from the flow of water; and/or a return pipe for discharging water from the separator chamber and for returning the discharged water to the pump to define a closed cycle system.

An outlet of the compressed air pipe may directly couple with the electrical power generator. The electrical power generator may be positioned directly over an outlet of the compressed air pipe. The electrical power generator may be vertically positioned directly over an outlet of the compressed air pipe. The electrical power generator may comprise a propeller end in line with the compressed air pipe. The electrical power generator may further comprise a propeller housing. An outlet of the compressed air pipe may directly couple with the propeller housing.

The outlet end of the air entrainment pipe may below a water level in the separating chamber. The separator chamber may comprise a dual water chamber. The first water chamber may comprise a first body of water which receives the flow of water and entrained air from an outlet end of the air entrainment pipe. The second water chamber may comprise a second body of water which receives overflow water from the first chamber and from which the pump receives the flow of water.

The at least one HAC may further comprise an air entrainment device for providing air to be entrained in and compressed by the flow of water from the recirculating pump. Additionally, the at least one HAC may further comprises a recharge pump for providing recharge water from an external source to the flow of water and a float in communication with the recharge pump for measuring water levels the separator chamber and operating the recharge pump.

The HACG system may comprise one, any combination, or all of the following: at least two HACs, each comprising an air entrainment pipe for transporting a flow of water and entrained air; a common separator chamber for separating entrained and compressed air from the flow of water, the common separator chamber in fluid communication with each air entrainment pipe; a common compressed air pipe for conveying the compressed air from the separator chamber, the common compressed air pipe comprising an inlet end in fluid communication with the separator chamber and an opposite outlet end; and/or an electrical power generator positioned in line with the outlet end of the common compressed air pipe so that the combined compressed air output from each of the HACs will directly power the generator.

Each HAC may further comprise one, a combination, or all of the following: a recirculating pump for providing a flow of water for compressing air; and/or a return pipe for discharging water from the common separator chamber and for returning the discharged water to the recirculating pump to define a closed cycle system.

The electrical power generator may comprise a propeller end in line with the common compressed air pipe. An outlet end of each air entrainment pipe may be below a water level in the separating chamber. The common separator chamber may comprise a dual water chamber, a first water chamber comprising a first body of water which receives the flow of water and entrained air from outlet ends of each air entrainment pipe, and a second water chamber comprising a second body of water which receives overflow water from the first chamber.

Each of the at least two HACs may further comprise an air entrainment device for providing air to be entrained in and compressed by the flow of water in the air entrainment pipe, a recharge pump for providing recharge water from an external source to the flow of water, or the combination of the foregoing.

In still another aspect, this document features a method for operating an electrical power generator. The method may include: positioning the electrical power generator in line with a compressed air pipe of a hydraulic air compressor; and using compressed air output from the HAC to directly power the electrical power generator.

Method implementations may include one, any combination, or all of the following: positioning a propeller end of the electrical power generator in line with a compressed air pipe of a HAC; positioning a propeller end of the electrical power generator in line with a compressed air pipe of a HAC; and/or positioning the electrical power generator in line with a common compressed air pipe shared between at least two HACs.

All of the foregoing and other implementations may have one or more of the following advantages.

HACG system implementations couple compressed air pipe outlet and a generator together (with no intermediate gas turbine or other fuel burning equipment) so that compressed air directly powers the electrical power generator. Accordingly, HACG system implementations are "green". That is, they power a generator directly without having to use carbon-based fuel burning equipment like a gas turbine for example, which pollute, to run a generator.

HACG system implementations with a pump allow water to be re-circulated in a closed cycle system. The use of a pump eliminates the need for an elevated entrainment head. Water may be pumped to an air entrainment pipe. This allows a hydraulic air compressor to be installed virtually anywhere. For example, it may be placed before and above a dam, and not below a dam. More importantly, it allows a hydraulic air compressor to be placed in a hole, as in the ground, a lake or the ocean, or even totally above the ground adjacent a structure (e.g., and existing structure or one specifically made to support the hydraulic air compressor).

HACG system implementations may combine a plurality of hydraulic air compressors together. The engineered compressed air output from each of these units may be used to run a single, larger generator to increase the amount of electricity being produced for greater power demands.

HACG system implementations are not dependent on wind, sun, or other undependable conditions (whether natural/renewable or man-made). They only require a little electricity off the grid or from a portable generator for example to jump start their operations. Once running, HACG system implementations may run continuously for long periods of time.

The foregoing and other aspects, implementations, features, and advantages will be apparent from the DESCRIPTION and DRAWINGS, and from the CLAIMS.

DRAWINGS

Implementations will hereinafter be described in conjunction with the appended DRAWINGS, where like designations denote like elements.

DESCRIPTION

A. Overview

Figure 1:
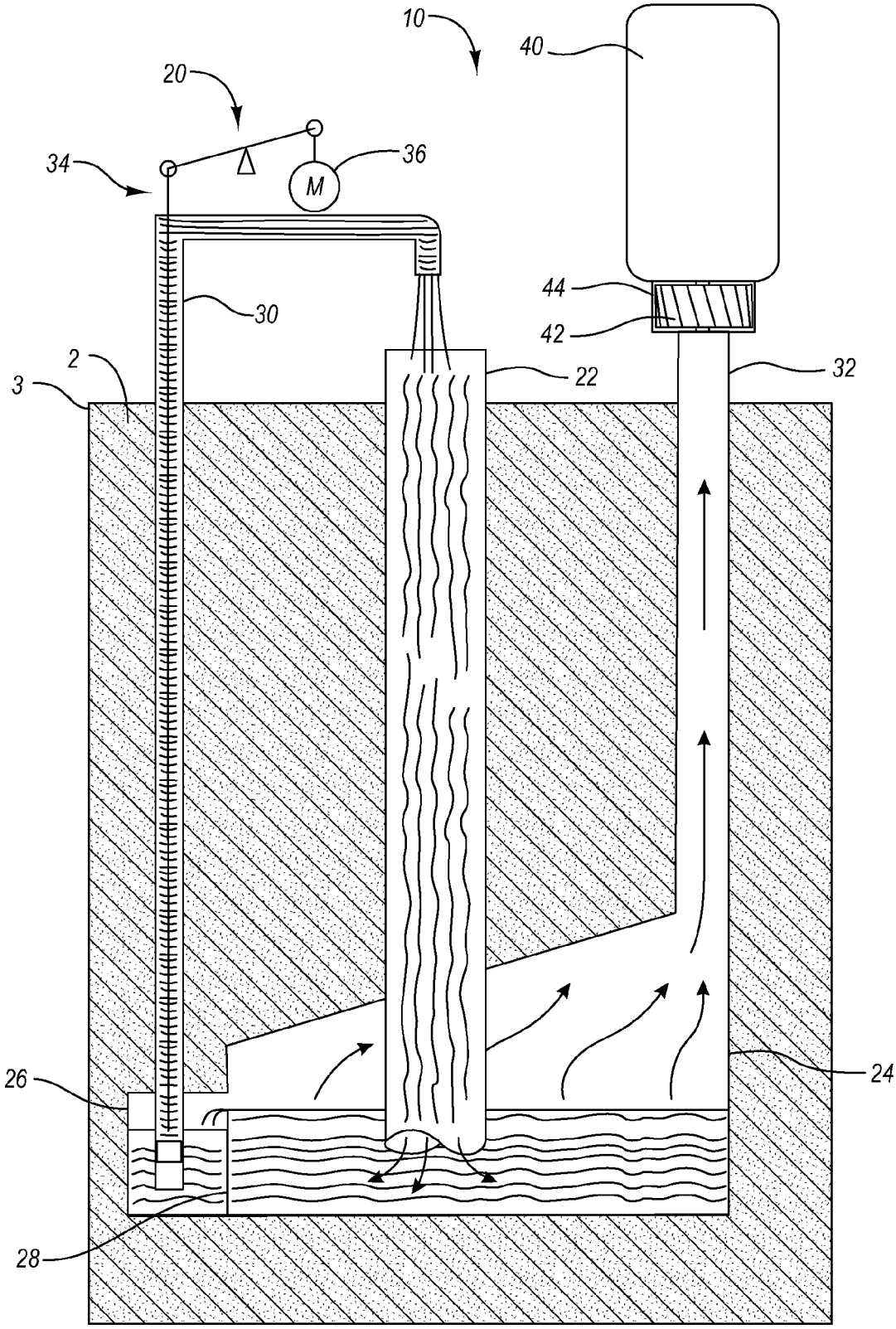
FIGS. 1-3 are front views in partial section of a hydraulic air compressor and generator (HACG) system implementation.

A hydraulic air compressor may have an air entrainment pipe for entraining air in falling water. The engineered compressed air output of the hydraulic air compressor may be used as a compressed air power source for directly running an electrical power generator. The hydraulic air compressor may includes a pump for providing a flow of water for entraining and compressing air to provide a closed cycle system, and it may also include an air pump or fan to increase the amount of air entrained in a given flow of water. Furthermore, a plurality of hydraulic air compressors may be employed in combination with the engineered compressed air output from each of them used to run a single, larger generator.

A. Structure

There is a variety of hydraulic air compressor and generator (HACG) system implementations. Notwithstanding, with reference to FIG. 1 and for the exemplary purposes of this disclosure, HACG 10 is depicted disposed in the ground 2. The ground 2 includes a top surface 3. HACG 10 extends downwardly into the ground 2 from the top surface 3. HACG 10 may have as its original source of water any appropriate water source, as from a river, a lake, a reservoir, a canal, a well, a swimming pool, man-made ponds and lakes, or the like.

An air entrainment pipe 22 extends downwardly to a separator chamber 24. The outlet of pipe 22 may be disposed within the separator chamber 24 and beneath the water level in chamber 24. Having the outlet of pipe 22 disposed beneath the water level in chamber 24 provides a seal, which prevents compressed air from "blowing back" up air entrainment pipe 22 and decreasing the velocity of the falling water, and, hence, the compression of the entrained air in the falling water.

Separator chamber 24 may comprise a dual water chamber. Separator chamber 24 itself may be the first water chamber and may comprise a first body of water which receives the flow of water and entrained air from the outlet end of air entrainment pipe 22. The second water chamber, chamber 26, may be separated from chamber 24 by partition 28. Chamber 26 may comprise a second body of water which receives overflow water from chamber 24 as depicted and from which pump 34 receives the flow of water.

Extending from chamber 26 is a water return pipe 30. The water flowing upwardly in the return pipe 30 is reused by the pump 34 for providing a flow of water to air entrainment pipe 22, the system operating on a closed water cycle. Thus, the water discharged in separator chamber 24 is recirculated. The recirculation of the water essentially comprises or defines a closed system.

Pump 34 may be an artificial-lift beam-pump (or sucker rod pump), Essentially pump 34 is an artificial-lift pumping system using a surface power source to drive a down hole pump assembly. In particular, pump 34 may comprise a beam set on a pivot, one end of the beam attached by a rod to a motor 36 powered from the external source (nor shown) and the other end of the beam attached to a vertical rod(s) or cable, the motions of which operate a down hole reciprocating pump. The pump contains a plunger and valve assembly or stack to convert the reciprocating motion to vertical fluid movement, basically "lifting" the water.

Extending from separator chamber 24 is a compressed air pipe 32. The compressed air pipe 32 extends to the generator 40 which utilizes the engineered compressed air output as a compressed air power source for running the generator 40.

The electrical power generator 40 is disposed on or above the top surface 3 of the ground 2. It may be supported by suitable framework members and may be positioned vertically over compressed air pipe 32. Electrical power generator 40 may comprise an external propeller 42 coupled to its drive shaft. Propeller 42 may be disposed within a propeller housing 44. Propeller housing may be coupled with compressed air pipe 32, or electrical power generator 40 may be positioned and supported separate from but adjacent to the outlet end of compressed air pipe 32.

B. Other Implementations

Many additional hydraulic air compressor and generator system implementations are possible.

Figure 2:
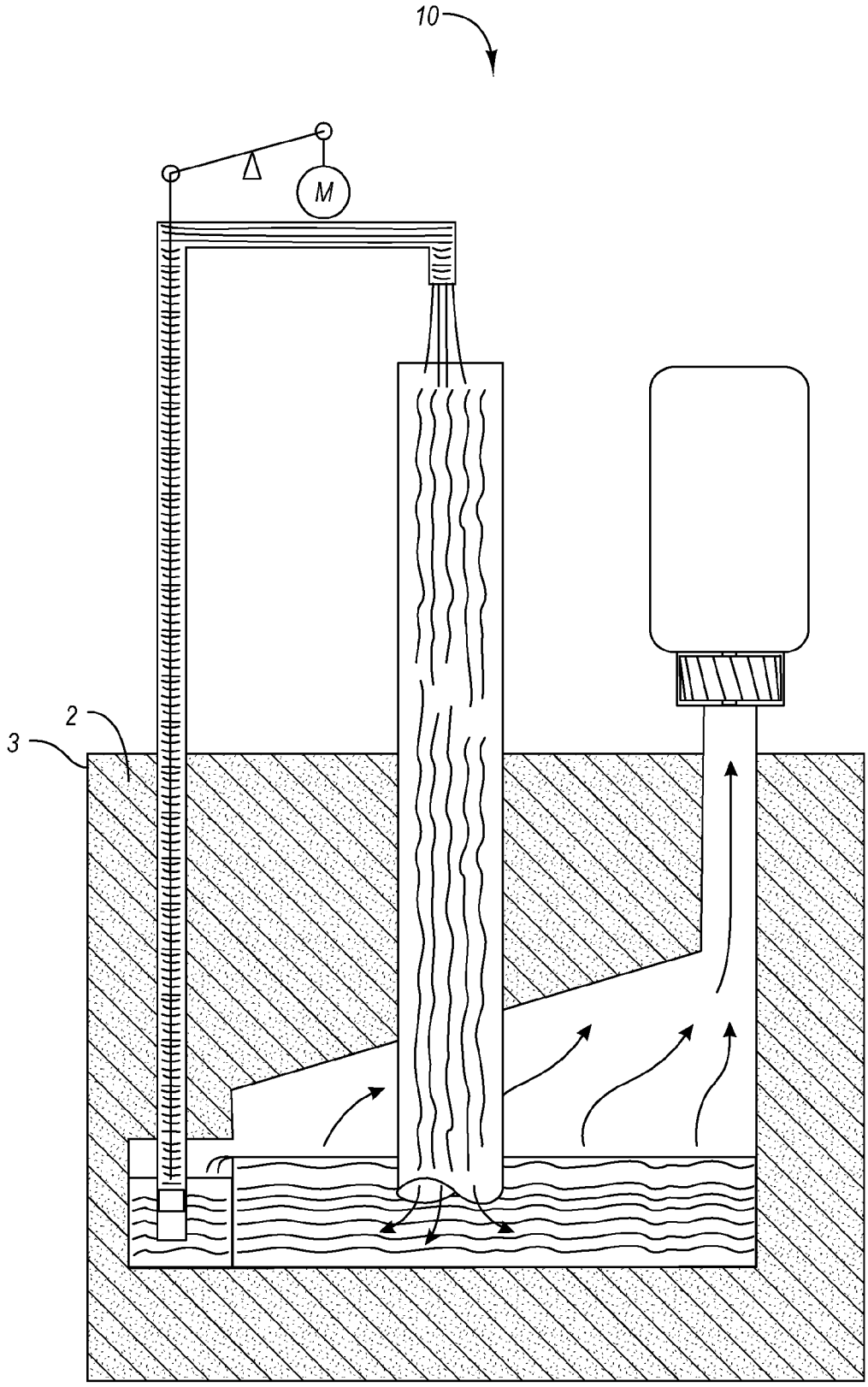
Figure 3:
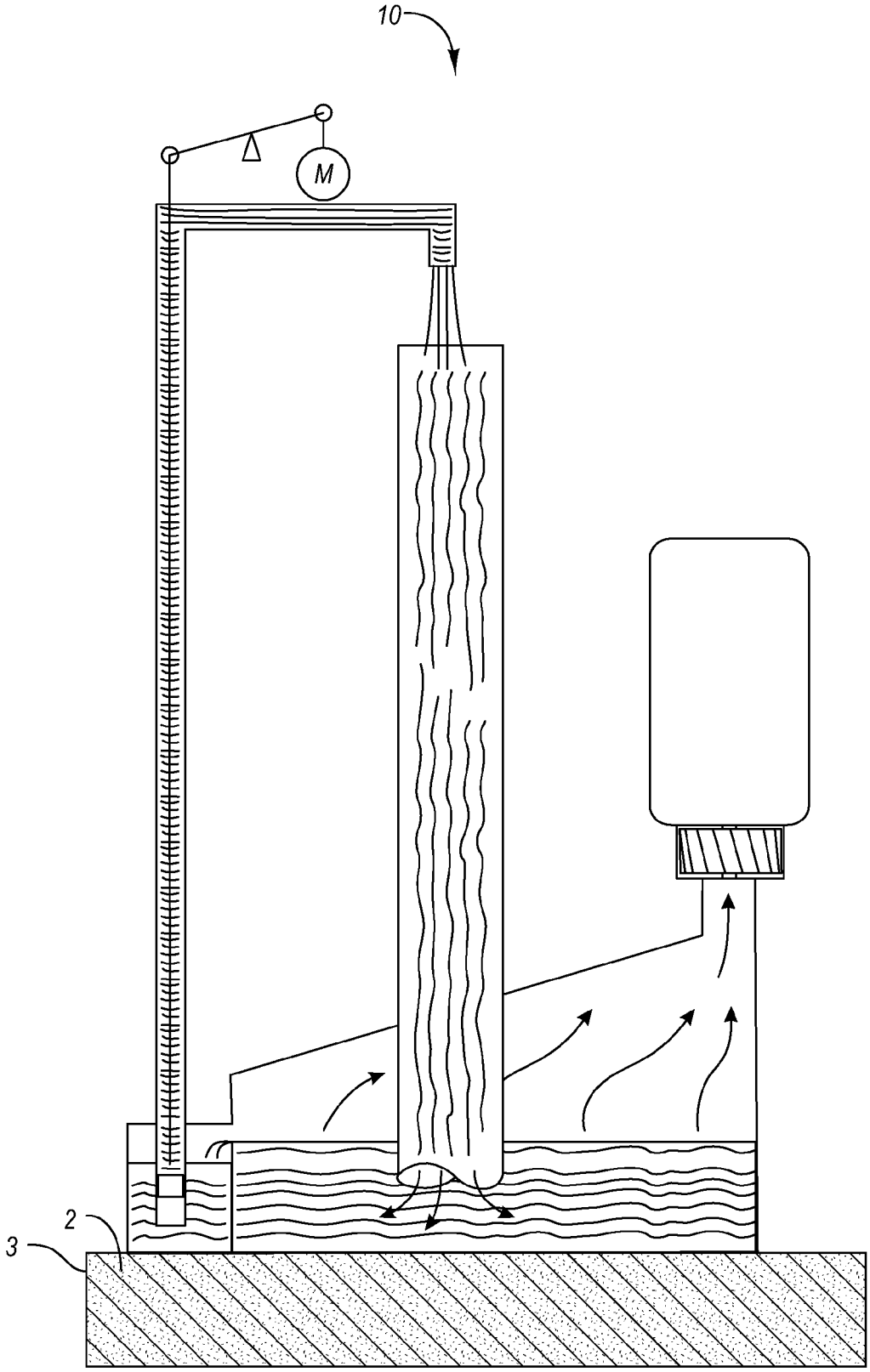

For the exemplary purposes of this disclosure and referring to FIG. 2, HACG 10 is depicted disposed partially in the ground 2 from the top surface 3. Turning to FIG. 3, HACG 10 is disposed on the top surface 3 of ground 2. In either scenario, it will be clear that appropriate support structure or framework, whether already existing in the form of a building, tower, stack, etc. or specific to HACG 10, would be employed to support HACG 10 and its operation. The use of pump 34 eliminates the need for an elevated entrainment head. Water may be pumped to the air entrainment pipe 22. This allows hydraulic air compressor 20 to be installed virtually anywhere.

Figure 4:
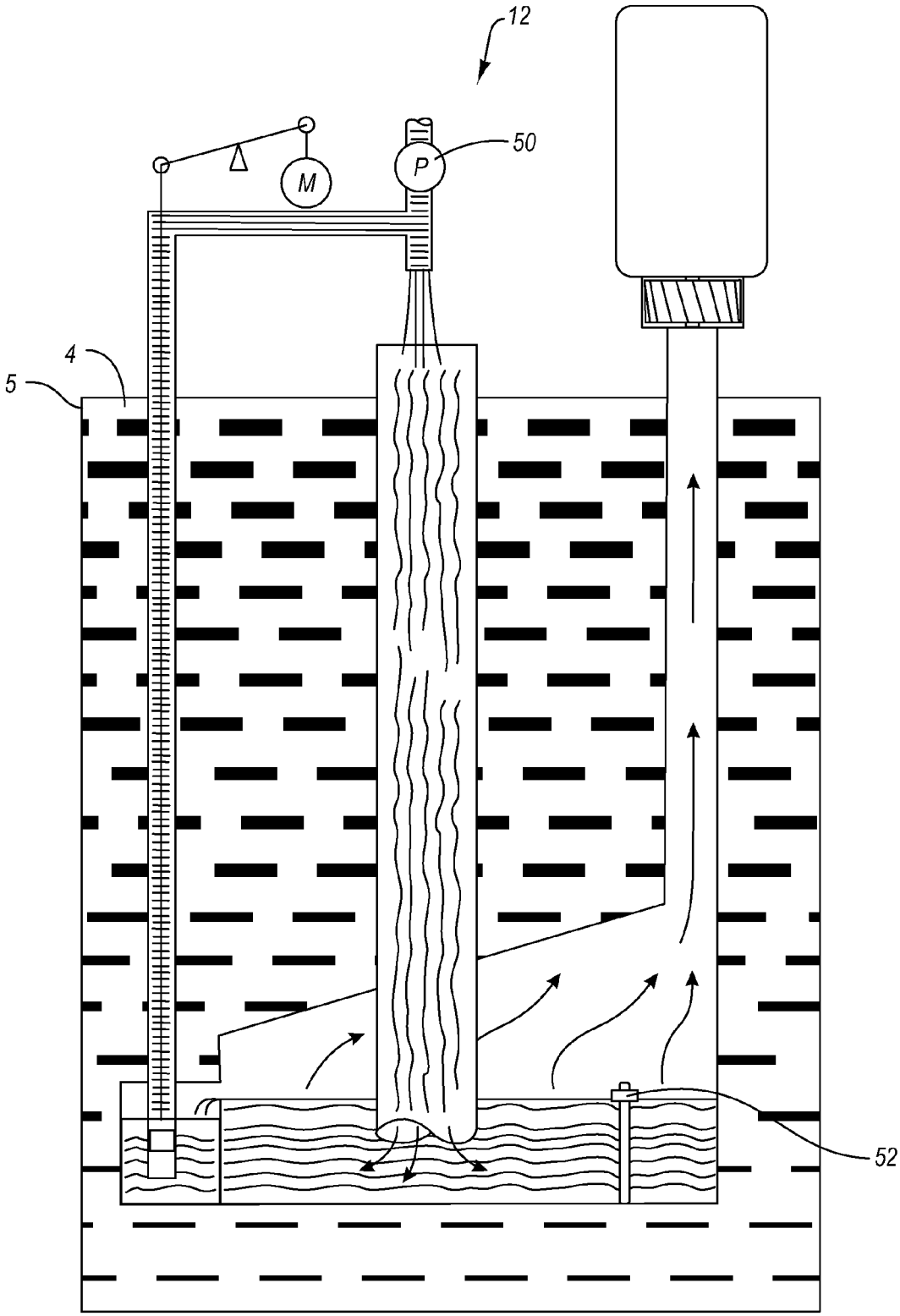
FIG. 4 is a front view in partial section of another HACG system implementation.

For the exemplary purposes of this disclosure and referring to FIG. 4, alternative HACG 12 is depicted disposed within a body of water 4. The body of water 4 includes a top surface 5. Even so, HACG 12 still operates on a true closed cycle and does not discharge water into the body of water 4. HAC 12 is substantially similar to HAC 10 as previously described. The principal differences between them relates to a recharge pump and a float. In particular, recharge pump 50 provides recharge water from an external source (in this case the body of water 4) to the flow of water as its levels decrease. Even though pump 50 may be occasionally required to provide recharge water, there still is a net gain in energy from HACG 12 even when pump 50 is used because the efficiency of HACG 12 is increased by a net gain of energy due to the increased efficiency over the energy required to power pump 50, and even to power the air pump or fan 60 as discussed below.

Float 52 is in communication with the recharge pump 50 for measuring water levels in the separator chamber 24 (or if located in chamber 26, the water levels in chamber 26) and operating the recharge pump 50. Float 52 accurately measures water levels and transmits signals to a controller for pump 50 to activate pump 50 until the water level rises. Float 52 may be a Magnetic Float Level Sensor, or float 52 may be any other liquid level sensor, such as a Mechanical Float Level Sensor or a Cable Suspended Float Level Sensor, or float 52 may even be a float valve. Various types of electrical controls may be required, none of which have been shown.

Figure 5:
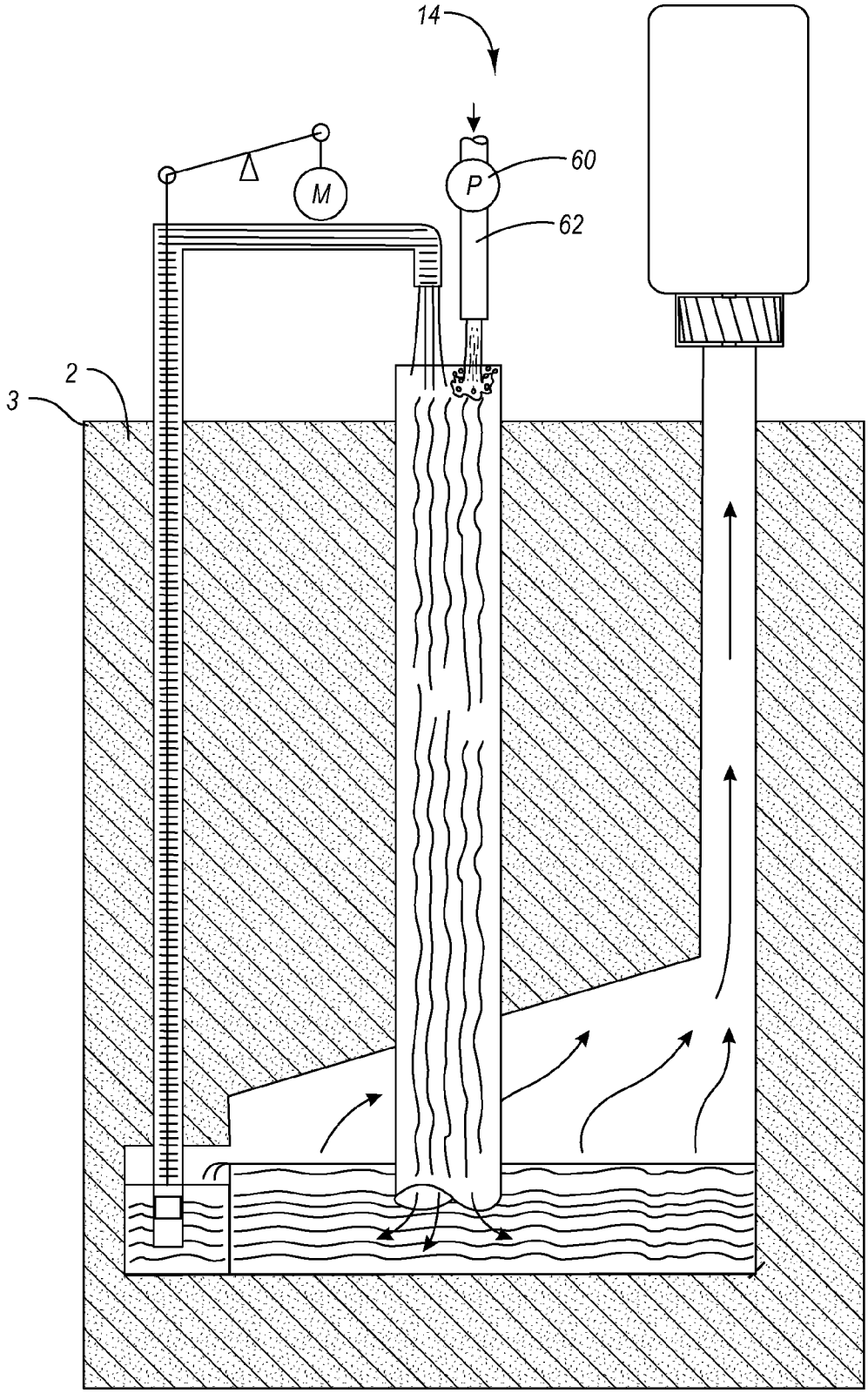
FIG. 5 is a front view in partial section of still another HACG system implementation.

For the exemplary purposes of this disclosure and referring to FIG. 5, alternative HACG 14 is depicted. HACG 14 is substantially similar to HACG 10 as previously described. The principal differences between them relates to an air entrainment device. In particular, air entrainment device 62 is included which comprises a pump 60 or a fan to increase the amount of air to be entrained in and compressed by a given flow of water from the recirculating pump 34. Air entrainment device 62 may be above the inlet of air entrainment pipe 22 or it may be located therein. If located in air entrainment pipe 22, air entrainment device 62 may have a flared or cone-shaped end which facilitates the more efficient entrainment of air in the flow of water (i.e., acts as a venturi to help pull the air into the stream of water, thus entraining the air into the falling water).

Figure 6:
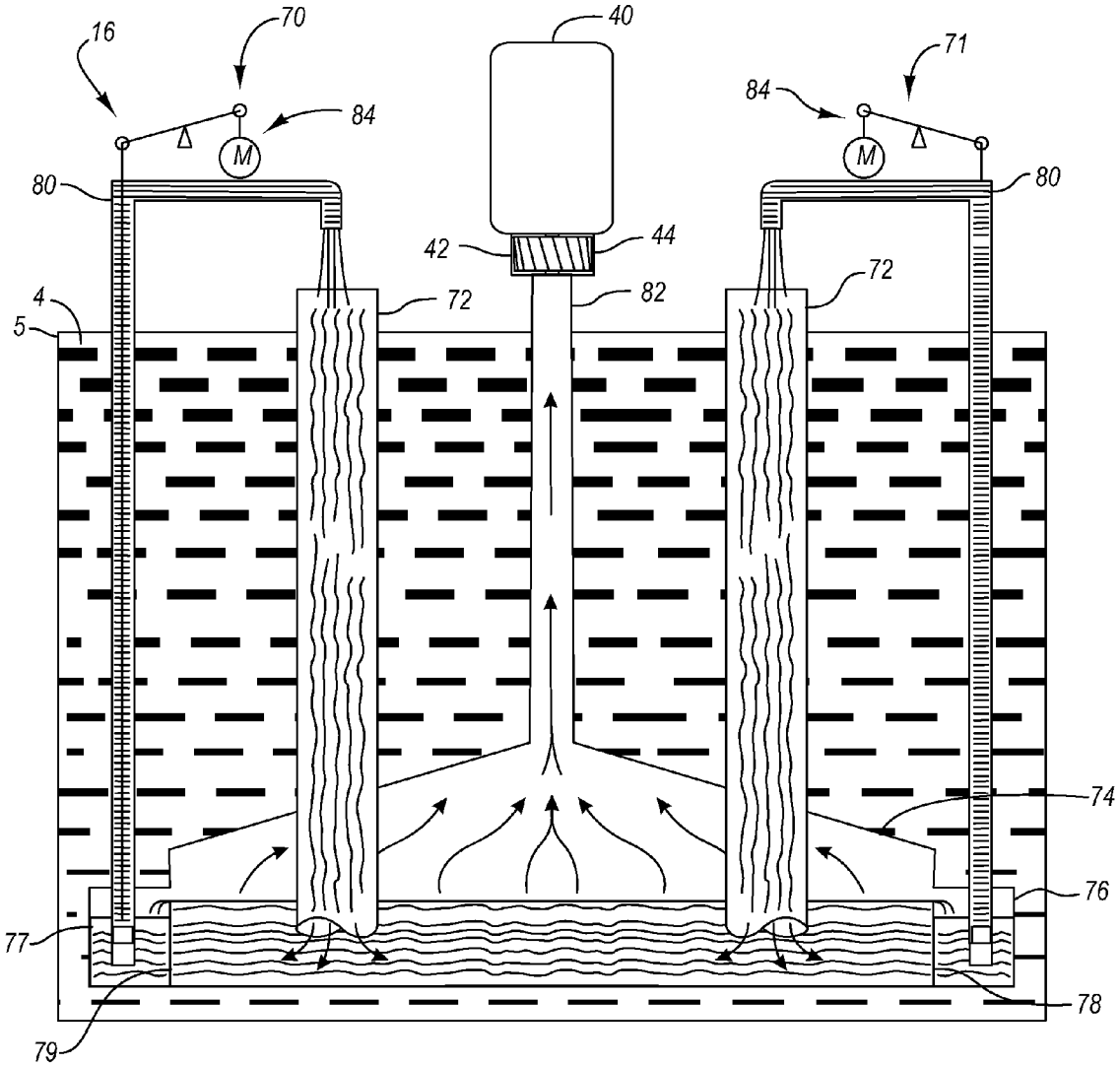
FIG. 6 is a front view in partial section of yet another HACG system implementation.
Figure 7:
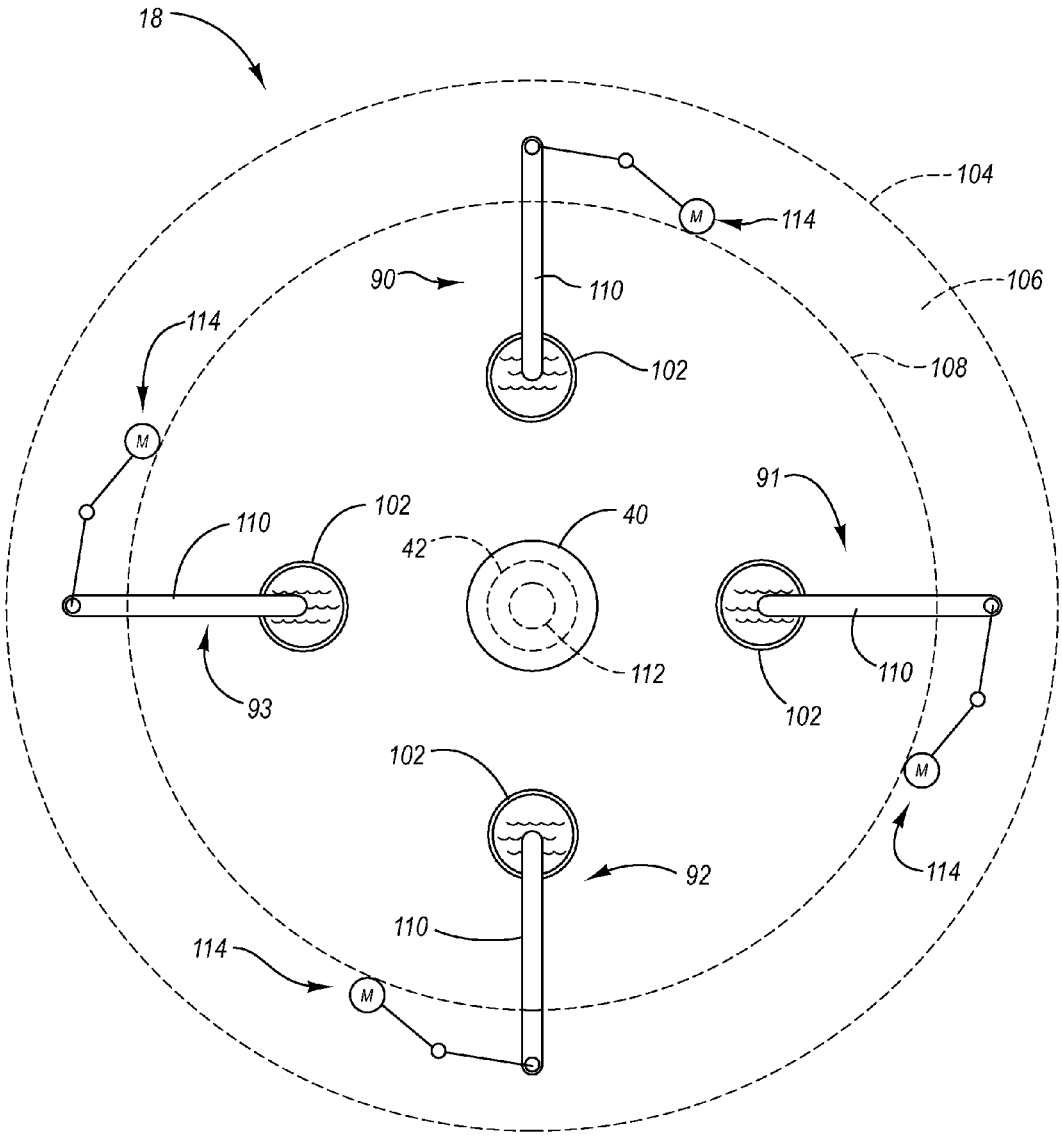
FIG. 7 is a top view of even another HACG system implementation.

For the exemplary purposes of this disclosure and referring to FIGS. 6 and 7, alternative HACGs 16 and 18 are depicted in different environments (in water 4 and in or on ground 2 respectively). HACGs 16 and 18 are substantially similar to HACG 10 as previously described. The principal differences between them relates to the combination of two or more HACs together so that they share a single compressed air pipe for conveying the engineered compressed air output from each individual HAC directly to a single, larger generator to increase the amount of electricity being produced in an environmentally friendly manner (e.g., no pollution).

In particular, turning to FIG. 6, each HAC 70 and 71 comprises its own air entrainment pipe 72 for transporting a flow of water and entrained air. They each also include a recirculating pump 84 powered from the external source (nor shown) for providing a flow of water for compressing air and a return pipe 80 for discharging water from the common separator chamber 74 and for returning the discharged water to the recirculating pump 84 to define a closed cycle system.

HACs 70 and 71 together share a common separator chamber 74 for separating entrained and compressed air from each flow of water. The common separator chamber 74 is in fluid communication with each air entrainment pipe 72. An outlet end of each air entrainment pipe 72 may be below a water level in the separating chamber 74.

The common separator chamber 74 may comprise a dual water chamber. Separator chamber 74 itself may be the first water chamber and may comprise a first body of water which receives the flow of water and entrained air from the outlet ends of each air entrainment pipe 72. The second water chamber, chamber 76 or 77, may be separated from chamber 74 by partition 78 or 79. Chamber 76 or 77 may comprise a second body of water which receives overflow water from chamber 74 as depicted and from which pumps 84 receive the flows of water.

HACs 70 and 71 also may share a common compressed air pipe 82 for conveying the compressed air from the common separator chamber 74. The common compressed air pipe 82 comprises an inlet end in fluid communication with the separator chamber 74 and an opposite outlet end.

The electrical power generator 40 is positioned in line with the outlet end of the common compressed air pipe 82 so that the combined compressed air output from each of the HACs 70 and 71 will directly power the generator 40. Electrical power generator 40 may comprise an external propeller 42 coupled to its drive shaft. Propeller 42 may be disposed within a propeller housing 44. The propeller end of generator 40 may be in line with the common compressed air pipe 82. For example, propeller housing 44 may be coupled with compressed air pipe 82, or electrical power generator 40 may be positioned and supported separate from but adjacent to the outlet end of compressed air pipe 82.

Referring to FIG. 7 now, HACG 18 and each HAC 90, 91, 92, and 93 are similar to HACG 16 and HACs 79 and 71 as previously described. Each HAC 90, 91, 92, and 93 comprises its own air entrainment pipe 102 for transporting a flow of water and entrained air. They each also include a recirculating pump 114 powered from the external source (nor shown) for providing a flow of water for compressing air and a return pipe 110 for discharging water from a common separator chamber and for returning the discharged water to the recirculating pumps 114 to define a closed cycle system.

HACs 90, 91, 92, and 93 together share a common separator chamber for separating entrained and compressed air from each flow of water. The common separator chamber is in fluid communication with each air entrainment pipe 102. An outlet end of each air entrainment pipe 102 may be below a water level in the separating chamber. The common separator chamber may comprise a dual water chamber similar to that as described for HACG 16.

HACs 90, 91, 92, and 93 also may share a common compressed air pipe 112 for conveying the compressed air from the common separator chamber. The common compressed air pipe 112 comprises an inlet end in fluid communication with the separator chamber and an opposite outlet end.

The electrical power generator 40 is positioned in line with the outlet end of the common compressed air pipe 112 so that the combined compressed air output from each of the HACs 90, 91, 92, and 93 will directly power the generator 40. Electrical power generator 40 may comprise an external propeller 42 coupled to its drive shaft. Propeller 42 may be disposed within a propeller housing. The propeller end of generator 40 may be in line with the common compressed air pipe 112. For example, the propeller housing may be coupled with compressed air pipe 112, or electrical power generator 40 may be positioned and supported separate from but adjacent to the outlet end of compressed air pipe 112.

Though not shown in FIGS. 6 and 7, each of the HACs 70, 71, 90, 91, 92, and 93 may further comprise an air entrainment device for providing air to be entrained in and compressed by the flow of water in the air entrainment pipe, a recharge pump for providing recharge water from an external source to the flow of water, or the combination of the foregoing.

For the exemplary purposes of this disclosure, other artificial lift technology may be used in place of pump 34. For example, progressing-cavity pumping (PCP) may be used. These systems are based on a surface drive rotating a rod string, which drives a down hole pump rotor operating within an elastomeric stator. Alternatively, a plunger lift may be employed. In a plunger lift, a freely moving plunger falls through fluids in the tubing and is lifted back to surface with its slug of mostly liquids by higher-pressure, formation gas (or injected gas) from the tubing-casing annulus. Additionally, an electrical submergible pump (ESP) may be employed. ESPs are an effective and economical means of lifting large volumes of fluid from great depths under a variety of pipe conditions. ESPs may be multistage centrifugal pumps that employ blades, or impellers, attached to a long shaft. The shaft may be connected to an electrical motor that is submerged in the pipe. The pump may be installed in the pipe just below the water level, and electricity may be supplied through a special heavy-duty armored cable.

For the exemplary purposes of this disclosure, alternative HACG system implementations may comprise any combination or all of the foregoing features together into one system. For example, one HACG system 10 may further comprise the combination of a water recharge pump, a float, and an air entrainment device.

For the exemplary purposes of this disclosure, alternative HACG system implementations may comprise electricity storage units (e.g. batteries or some other capacitors) that are rechargeable. Accordingly, once their operation is jump started with a little electricity off the grid or from a portable generator for example and they are running, they can recharge their electricity storage units. Then, when they need to be started again, HACG systems can draw from the stored electricity in their electricity storage units and not have to use "dirty energy" from the grid or a portable generator.

Further implementations are within the CLAIMS.

C. Specifications, Materials, Manufacture, and Assembly

It will be understood that HACG system implementations are not limited to the specific components disclosed herein, as virtually any components consistent with the intended operation of a HACG system implementation may be utilized. Accordingly, for example, although particular components for HACG system implementations are disclosed, such components may comprise any shape, size, style, type, model, version, measurement, concentration, material, quantity, and/or the like consistent with the intended operation of a HACG system implementation. Implementations are not limited to uses of any specific components, provided that the components selected are consistent with the intended operation of a HACG system implementation. Additionally, many modifications of structure, arrangement, proportions, materials, and components may be used, which are particularly adapted to specific environments and operative requirements.

Accordingly, the components defining any HACG system implementation may be formed of any of many different types of materials or combinations thereof that can readily be formed into shaped objects provided that the components selected are consistent with the intended operation of a HACG system. For example, the components may be formed of: rubbers (synthetic and/or natural) and/or other like materials; glasses (such as fiberglass), carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any HACG system implementation may be manufactured separately and then assembled together. The various implementations may be manufactured using conventional procedures as added to and improved upon through the procedures described here. Accordingly, manufacture of these components may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. Components may then be coupled or removably coupled with one another in any manner, such as with adhesive, a weld, a fastener (e.g. a bolt, a nut, a screw, a nail, a rivet, a pin, and/or the like), retainers, wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

It will also be understood that the assembly and disassembly of HACG system implementations is not limited to any specific order of steps. Various assembly and disassembly processes and sequences of steps may be used to assemble and disassemble HACG system implementations.

D. Use

HACG system implementations may be used with similar results in a variety of applications. For example, implementations may be used in manufacturing facilities, hospitals, universities, waste water treatment facilities, prisons, ranches, mines, housing developments, assembly plants, air control towers, office buildings, skyscrapers, gas stations, off-shore drilling rigs, petroleum production facilities, and/or the like just to name a few.

For some embodiments, the hydraulic air compressor could simply be installed in a hole in the ground adjacent to a canal, a lake, etc. Others could be installed above ground supported by frameworks of their own or supported by existing structures, such as buildings, towers, stacks, cliffs, etc. Others could be installed in or partially in bodies of water, such as oceans, seas, lakes, ponds, rivers, canals, etc.

On page 84 of the November 2006 issue of Popular Mechanics magazine, the article by Jeff Wise states that the biggest problem today with a hydrogen economy is using "dirty" energy to make "clean" or "green" energy. As he states: "[t]his doesn't solve the pollution problem—it just moves it around". Accordingly, HACG system implementations may also be used to generate "green", pollution free electricity that can operate equipment (such as GE's low-cost electrolyzer described on page 82 of the November 2006 issue of Popular Mechanics magazine) and processes used to produce hydrogen from water, thereby producing hydrogen without any carbon emissions at all. But this is not the only advantage. Water could be split "on-site" with HACG system implementations. HACG system implementations also are not dependent on the unpredictable or inconsistent conditions that plague wind, solar, and other renewable resources.

Describing the use and operation of HACG system implementations further, reference is made to FIG. 1. In particular, HACG 10 may have as its original source of water any appropriate water source, as from a river, a lake, a reservoir, a canal, a well, a swimming pool, man-made ponds and lakes, or the like. This original water may come from a water intake pipe that may be closed by a filter on its lower end for example. Water may be pumped through the filter and through the water intake pipe directly into the air entrainment pipe 22 for example.

The water flowing down air entrainment pipe 22 causes air to flow downwardly into the pipe as well. The water flowing downwardly mixes with or entrains the air. The falling water and air mixture causes the air entrained in the water to be compressed as the air and water flow downwardly in the air entrainment pipe 22.

The water and air falling or flowing in the air entrainment pipe 22 flows into the separator chamber 24. Having the outlet of pipe 22 disposed beneath the water level in chamber 24 provides a seal. Therefore, as the water and air flows into the separator chamber 24 the entrained, compressed air (shown as arrows) bubbles up and separates from the water and rises to the top of the chamber 24 without any compressed, separated air "blowing back" up air entrainment pipe 22 and decreasing the velocity of the falling water, and, hence, the compression of the entrained air in the falling water.

The compressed, separated air then flows upwardly through a compressed air pipe 32 from the separator 24. The compressed air pipe 32 extends to the generator 40 which utilizes the engineered compressed air output as a compressed air power source for running the generator 40 directly. Specifically, the engineered compressed air output turns the propeller 42, thereby operating generator 40 to produce electricity without any carbon emissions.

Overflow water in separator 24 is displaced over partition 28 into chamber 26. From chamber 26, water is returned or recycled back to the top of air entrainment pipe 22 through return pipe 30 extending from chamber 26 using pump 34. Thus, the water flowing upwardly in the return pipe 30 is reused by the pump 34 for providing a flow of water to air entrainment pipe 22, the system operating on a closed water cycle.

Turning to FIG. 6, HACG system 16 is depicted. HACG systems 16, 18, and other HACG systems that employ two ore more HACs may be used and operate in a similar fashion to the HACG system 10 as previously described. An advantage in using and operating HACG systems 16, 18, and other HACG systems that employ two ore more HACs is that they share a single compressed air pipe for conveying the engineered compressed air output from each of the individual HACs directly to a generator to increase the amount of electricity being produced, again in an environmentally friendly manner with no pollution.

The invention claimed is:

1. A hydraulic air compressor and generator (HACG) system comprising:

at least one hydraulic air compressor (HAC) comprising a compressed air pipe for conveying compressed air; and an electrical power generator comprising a propeller end in line with the compressed air pipe so that compressed air will directly power the electrical power generator.

2. The HACG system of claim 1, wherein the at least one HAC comprises at least two HACs sharing the compressed air pipe for conveying compressed air.

3. The HACG system of claim 1, wherein an outlet of the compressed air pipe directly couples with the electrical power generator.

4. The HACG system of claim 1, wherein the electrical power generator is positioned directly over an outlet of the compressed air pipe.

5. The HACG system of claim 1, wherein the electrical power generator comprises a propeller end in line with the compressed air pipe.

6. The HACG system of claim 1 further comprising:

an air entrainment pipe for transporting a flow of water and entrained air;

a separator chamber in fluid communication with the air entrainment pipe for separating entrained and compressed air from the flow of water.

7. The HACG system of claim 6, wherein an outlet end of the air entrainment pipe is below a water level in the separating chamber.

8. The HACG system of claim 6, wherein the separator chamber includes a dual water chamber, a first water chamber for receiving the flow of water and entrained air from an outlet end of the air entrainment pipe, and a second water chamber for receiving overflow water from the first chamber.

9. The HACG system of claim 6, wherein the at least one HAC further comprises an air entrainment device for providing air to be entrained in and compressed by the flow of water.

10. The HACG system of claim 6, wherein the at least one HAC further comprises a recharge pump for providing recharge water from an external source to the flow of water.

11. The HACG system of claim 6, wherein the at least one HAC further comprises a float for measuring water in the separator chamber.

12. A hydraulic air compressor and generator (HACG) system comprising:

at least two hydraulic air compressors (HACs), each HAC comprising an air entrainment pipe for transporting a flow of water and entrained air;

a common separator chamber for separating entrained and compressed air from the flow of water, the common separator chamber in fluid communication with each air entrainment pipe;

a common compressed air pipe for conveying the compressed air from the separator chamber, the common compressed air pipe comprising an inlet end in fluid communication with the separator chamber and an opposite outlet end; and an electrical power generator comprising a propeller end in line with the outlet end of the common compressed air pipe so that the combined compressed air output from each of the HACs will directly power the generator.

13. The HACG system of claim 12, wherein an outlet end of each air entrainment pipe is below a water level in the separating chamber.

14. The HACG system of claim 13, wherein the common separator chamber includes a dual water chamber, a first water chamber for receiving the flow of water and entrained air from outlet ends of each air entrainment pipe, and a second water chamber for receiving overflow water from the first chamber.

15. The HACG system of claim 12, wherein each of the at least two HACs further comprises an air entrainment device for providing air to be entrained in and compressed by the flow of water in the air entrainment pipe.

16. A method for operating an electrical power generator, the method comprising:

positioning a propeller end of the electrical power generator in line with a compressed air pipe of a hydraulic air compressor (HAC); and using compressed air output from the HAC to directly power the generator.

17. The method of claim 16 wherein the step of positioning the electrical power generator comprises positioning the electrical power generator in line with a common compressed air pipe shared between at least two HACs, and wherein the step of using compressed air output comprises using combined compressed air output from the at least two HACs to directly power the generator.

* * * * *

UNITED STATES PATENT AND TRADEMARK OFFICE

CERTIFICATE OF CORRECTION

PATENT NO. : 7,696,632 B1
APPLICATION NO. : 11/555758
DATED : April 13, 2010
INVENTOR(S) : Steve Fuller It is certified that error appears in the above-identified patent and that said Letters Patent is hereby corrected as shown below:

Column 9, delete Claim 5

Signed and Sealed this

Twenty-first Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,696,632 B1
APPLICATION NO. : 11/555758
DATED : April 13, 2010
INVENTOR(S) : Steve Fuller It is certified that error appears in the above-identified patent and that said Letters Patent is hereby corrected as shown below:

Delete the title page and substitute therefore the attached title page showing the corrected number of claims in patent.

Column 9, lines 57-59, delete Claim 5.

This certificate supersedes the Certificate of Correction issued December 21, 2010.

Signed and Sealed this
Twenty-fifth Day of January, 2011

David J. Kappos

David J. Kappos
*Director of the United States Patent and Trademark Office*

(12) United States Patent
Fuller

(10) Patent No.: US 7,696,632 B1
(45) Date of Patent: Apr. 13, 2010

(54) HYDRAULIC AIR COMPRESSOR AND GENERATOR SYSTEM

(76) Inventor: Steve Fuller, 15 N. 17th St., Cottonwood, AZ (US) 86326

( * ) Notice: Subject to any disclaimer, the term of this patent is extended or adjusted under 35 U.S.C. 154(b) by 173 days.

(21) Appl. No.: 11/555,758

(22) Filed: Nov. 2, 2006

(51) Int. Cl.
*F02C 3/12* (2006.01)
*F04F 11/00* (2006.01)

(52) U.S. Cl. ..... 290/54, 290/43

(58) Field of Classification Search ..... 290/1 R, 290/43, 54, 44, 55, 52, 42, 53; 60/370
See application file for complete search history.

(56) References Cited

U.S. PATENT DOCUMENTS

| | | | | |
|---|---|---|---|---|
| 892,772 | A | 7/1908 | Taylor | |
| 1,007,095 | A | 10/1911 | Girard | |
| 2,013,236 | A | 9/1935 | Dell | |
| 2,382,421 | A | 8/1945 | Johnson et al. | |
| 2,478,051 | A * | 8/1949 | Nordell | 417/320 |
| 2,861,737 | A | 11/1958 | Bowen | |
| 4,307,299 | A | 12/1981 | Norton | |
| 4,345,160 | A * | 8/1982 | Smith | 290/52 |
| 4,408,452 | A * | 10/1983 | Tsunoda | 60/398 |
| 4,443,707 | A * | 4/1984 | Scieri et al. | 290/4 R |
| 4,797,563 | A | 1/1989 | Richardson | |
| 5,099,648 | A | 3/1992 | Angle | |
| 5,142,870 | A | 9/1992 | Angle | |
| 6,051,892 | A * | 4/2000 | Toal, Sr. | 290/43 |
| 6,272,839 | B1 | 8/2001 | Karl | |
| 6,861,766 | B2 * | 3/2005 | Rembert | 290/43 |

* cited by examiner

*Primary Examiner*—Nicholas Ponomarenko
(74) *Attorney, Agent, or Firm*—Booth Udall, PLC

(57) ABSTRACT

A hydraulic air compressor and generator system may comprise: a hydraulic air compressor comprising a compressed air pipe for conveying the compressed air from the separator chamber; and an electrical power generator positioned in line with the compressed air pipe so that compressed air will directly power the generator. A method for operating an electrical power generator may comprise: positioning the electrical power generator in line with a compressed air pipe of a hydraulic air compressor; and using compressed air output from the HAC to directly power the electrical power generator.

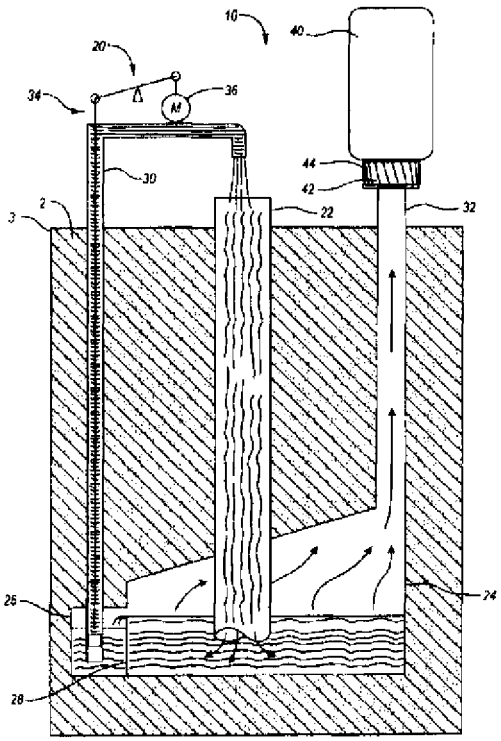

16 Claims, 7 Drawing Sheets